US005374027A

United States Patent [19]

Tsai

[11] Patent Number: 5,374,027

[45] Date of Patent: Dec. 20, 1994

[54] CLAMPING DEVICE FOR CARRYING BARRELS

[76] Inventor: Cheng-Fung Tsai, 9F, 158, Sung Chiang Rd., Taipei 104, Taiwan, Prov. of China

[21] Appl. No.: 112,715

[22] Filed: Aug. 26, 1993

[51] Int. Cl.[5] ..... B66F 9/18

[52] U.S. Cl. ..... 294/90; 294/104; 414/607; 414/621

[58] Field of Search ..... 414/621–623, 414/607, 445, 452–454, 450; 294/90, 104

[56] References Cited

U.S. PATENT DOCUMENTS

| | | | |
|---|---|---|---|
| 1,439,227 | 12/1922 | Cochran | 414/622 |
| 2,545,021 | 3/1951 | Coupland et al. | 414/622 |
| 2,698,107 | 12/1954 | Ericson | 414/621 |
| 2,713,433 | 7/1955 | Gardner et al. | 414/445 X |
| 3,400,966 | 9/1968 | Creel et al. | 414/623 X |
| 3,645,577 | 2/1972 | Peper | 294/104 |
| 4,068,880 | 1/1978 | Kikuchi | 294/90 |
| 4,130,212 | 12/1978 | Gatilao | 414/621 |
| 4,243,354 | 1/1981 | Garcia | 414/622 X |
| 4,515,522 | 5/1985 | Sonerud | 294/104 X |
| 4,685,713 | 8/1987 | Van der Hulst et al. | 294/90 |

FOREIGN PATENT DOCUMENTS

| | | | |
|---|---|---|---|
| 1375557 | 2/1988 | U.S.S.R. | 414/623 |
| 1689282 | 11/1991 | U.S.S.R. | 294/104 |

*Primary Examiner*—David A. Bucci

[57] ABSTRACT

A clamping device for carrying barrels having end frame rims is supported on a housing adapted to be lifted by a fork lift truck. Upper and lower clamping heads carried by a parallelogram link mechanism pivotally supported on a bearing holder mounted at the upper end of the housing are normally urged upwardly to a released position by a counterweight carried by one of the links which comprise the link mechanism. When the lower clamping head is engaged with the rim of a barrel and the housing is elevated by a lift truck the parallelogram linkage moves the upper clamping head downwardly toward the lower clamping head against the action of the counterweight and into cooperating clamping relation to the lower clamping head to grip and hold an upper portion of the barrel.

3 Claims, 3 Drawing Sheets

CLAMPING DEVICE FOR CARRYING BARRELS

FIELD OF INVENTION

The present invention relates to a clamping device suitable for use with barrels having end frame rims. Said device is a clamping mechanism composed of a set of links in which the clamping mechanism holding the top rim of a barrel will be caused to hold tighter because of the tendency of the barrel to fall down due to its own weight.

BACKGROUND OF THE INVENTION

For convenience, description is given in the following with reference to a 50 gallon metal barrel as an example.

At present, moving 50 gallon metal barrels is a job requiring manual labor. Moving 50 gallon barrels is disadvantageous and a slow operation because the barrels must be loaded onto, and off from a carrier by hand. Besides, for barrels containing poisonous substances, manual loading and unloading operations involve potential hazards to the handlers.

SUMMARY OF THE INVENTION

In view of the above, and after extensive research, the inventor has provided a clamping mechanism for 50 gallon barrels suitable for use with a fork lift. When the clamping mechanism is lifted by the fork lift, the clamping mechanism will be actuated by the weight of the barrel which automatically holds the top frame rim of the barrel, which is the primary object of the present invention.

According to the present invention, by only moving the clamping mechanism to engage against and beneath the frame rim of the barrel, and then moving it up, the clamping device will automatically clamp tightly at the top frame rim for carrying by the fork lift. The clamping mechanism, when lowering a barrel from the fork lift, will automatically release the barrel. As a result, there is no manual contact with the barrel during the process when the barrels are moved, thus ensuring operation safety for the moving workers, which is another object of the present invention. According to the present invention, since no handlers are needed for loading and unloading operations, moving efficiency is substantially increased with few workers, thus resulting in reduced moving costs, which is still another object of the present invention.

BRIEF DESCRIPTION OF DRAWINGS

For a substantial understanding of these and other objects of the present invention, an embodiment is described in connection with the accompanying drawings, in which.

DETAILED DESCRIPTION OF DRAWINGS

Figure 1:
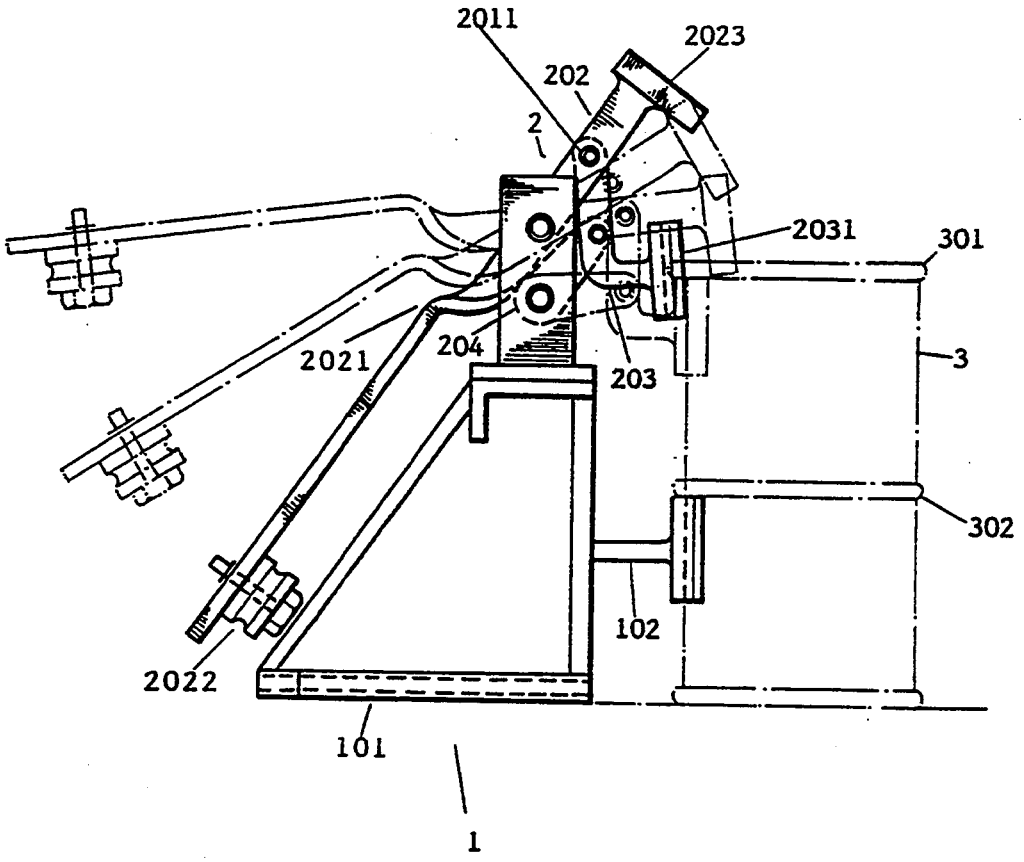
FIG. 1 is a front elevation view of the present invention with chain lines illustrating a metal barrel to be held in front of the clamping device and the schematic situation of part of the operation process.
Figure 2:
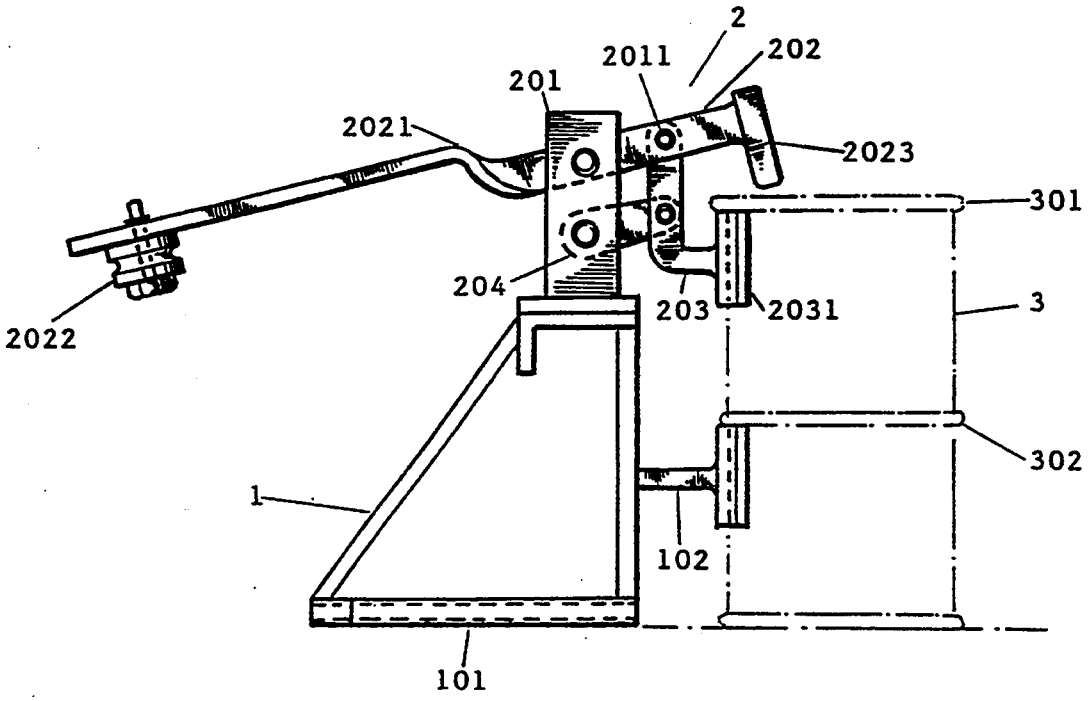
FIG. 2 is a schematic view showing the present invention before holding action.

First referring to FIGS. 1 and 2, there is shown a clamping mechanism 2 fixed on a housing 1 and comprising a set of four links. The four link mechanism 2 comprises a fixed bearing holder 201, an upper clamp swing link 202, a lower clamp link 203, and a support column 204. The upper clamp swing link 202 is pivotally connected at the middle portion of the fixed bearing holder 201, the right portion being pivotally connected to one end of the lower clamp link 203, and the left portion being twisted at a suitable position, such as the position at 2021, for 90 degrees, and then extended therefrom for a suitable distance, and having a counterweight 2022 secured at its proximal end so that the upper clamp swing link 202 always tends to remain upward. Finally, an upper clamping head 2023 is vertically secured at the distal end extremity of the upper clamp swing link 202. The lower clamp link 203 having one end pivotally connected to the upper clamp swing link 202, after being pivotally connected at a suitable position in the other direction to one end of the support column 204 pivotally connected to the fixed bearing holder 201, is bent for 90 degrees in the direction of the upper clamping head 2023 and configured as shown in FIG. 1, and a lower clamping head 2031 of a curvature corresponding to that of the metal barrel being secured to its extremity, and maintaining properly spaced apart from the upper clamping head 2023.

According to the present invention, if a conventional moving apparatus, such as a fork lift (not shown) is used to move 50 gallon barrels, the two front forks of the lifter are first inserted into the guide rails 101 (only one of which shown in FIGS. 1 and 2) beneath the housing 1. Then moving to the metal barrel 3, the lower clamping head 2031 is adjusted to a position just below the top frame rim 301 on the top end of the metal barrel 3 by lowering or raising the front forks of the lifter.

After this preparatory procedure, the front forks of the fork lift are raised. Then, the lower clamping head 2031 is blocked by the frame rim 301 so that the lower clamping head 2031 can not be raised by the weight of the metal barrel 3. However, the upper clamp swing link 202 is pulled down by the lower clamp link 203 in conjunction with the fixed bearing holder 201 tending to go up, and caused to turn about a shaft pin 2011 on the fixed bearing holder 201 so that the upper clamping head 2023 is inclined forward, and finally gets into the inner side of the frame rim 301, the metal barrel thus being clamped at the frame rim 301 by the mating upper clamping head 2023 and the lower clamping head 2031. At the same time, another auxiliary support 102 provides additional hold just under middle rib 302 of the metal barrel 3. In this way, the metal barrel 3 is securely held by the clamping mechanism 2 and can be carried by the fork lift to its depositing location. Now, if the forks of the lift are lowered, and the metal barrel 3 touches the ground, the lower clamping head 2031 will go down with the housing 1, its lowering distance causing the counterweight 2022 to turn the upper clamping head 2023 of the upper clamp swing link 202 to go up again, and thus having the clamping of the frame rim 301 released, and finally go back to the typical holding position as shown by solid lines in FIG. 1. The housing 1 can be moved to the left for the next holding operation.

Figure 3:
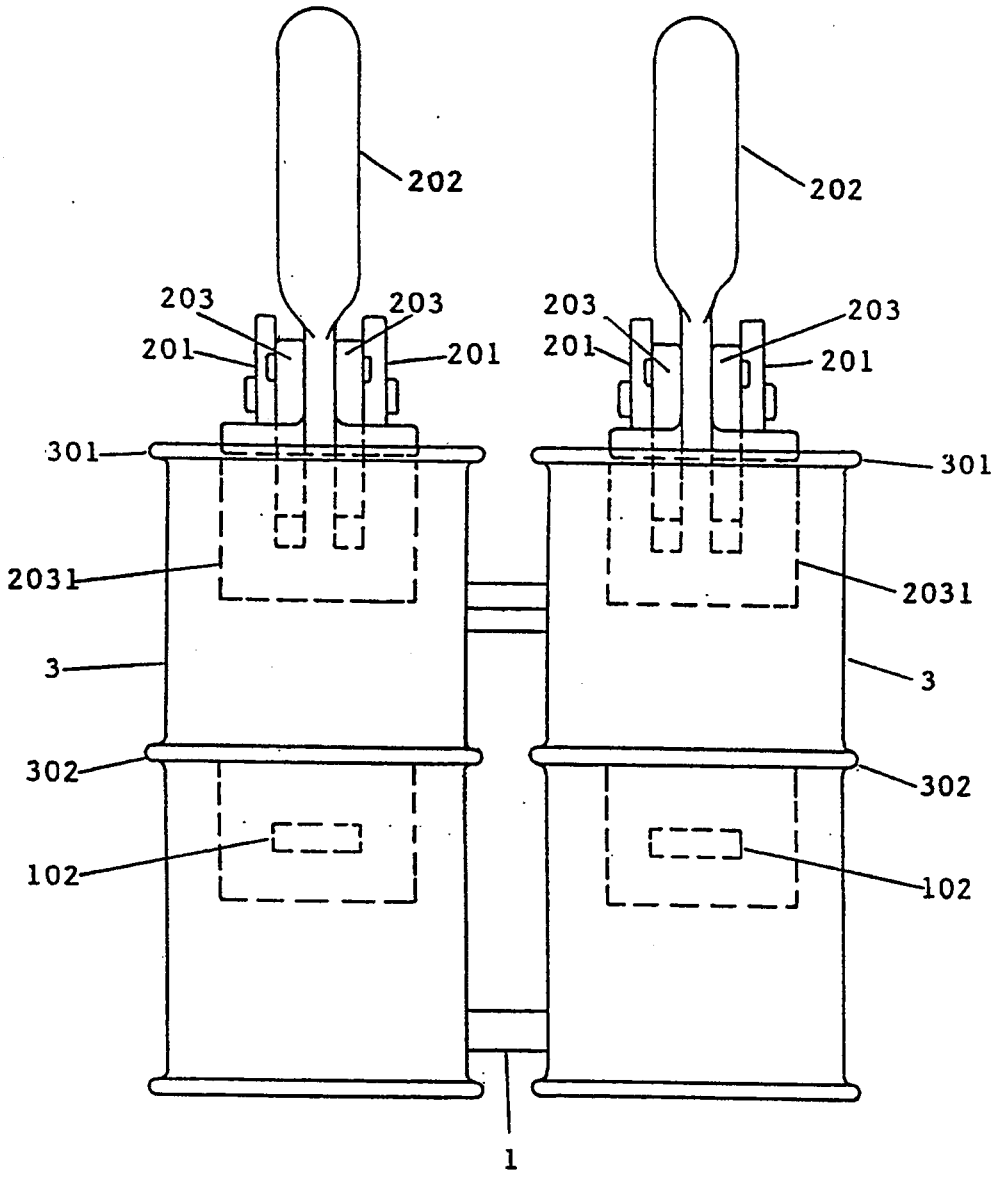
FIG. 3 is a right side view of the present invention shown in FIG. 1.

Two sets of the clamping mechanism have been constructed according to the present invention as shown in FIG. 3. After actual operation, it is proved that they are improved and practical clamping mechanisms and can achieve said objects and functions.

It is understood by those skilled in the art that this invention should not be construed as restricted to the above described embodiment and that various changes and modifications may be made in the invention without departing from the gist and scope thereof.

I claim:

1. A clamping device for carrying barrels and objects having end frame rims, said clamping device is fixed on a housing (1) and comprises a fixed bearing holder (201);

an upper clamp swing link (202) pivotally connected on said bearing holder (201), a counterweight (2022) being secured at a suitable length from one end thereof so that said upper clamp swing link (202) always tends to remain upward, another end being pivotally connected at a suitable length to one end of a lower clamp link (203) and having an upper clamping head (2023) vertically secured at its extremity;

said lower clamp link (203) having another end thereof pivotally connected at a suitable position to a support column (204) having one end pivotally connected on said bearing holder (201), and said other end being bent upward at a suitable distance in a direction of said upper clamping head (2023) and having a lower clamping head (2031) vertically secured at an extremity and spaced apart from said upper clamping head (2023), so that when said lower clamping head (2031) comes to engage the frame rim (301) at a top end of a barrel (3), said moving lower clamping head (2031) is blocked as said bearing holder (201) goes up, movement of said lower clamping head being converted to bring said upper clamp swing link (202) to pivot, causing said upper clamping head (2023) to turn toward an inner side of said frame rim (301) and, together with said lower clamping head (2031), hold said frame rim (301) of said barrel (3).

2. The clamping device for carrying barrels and objects according to claim 1 wherein the lower clamping head (2031) is arc shaped.

3. The clamping device for carrying barrels and objects according to claim 1 wherein an auxiliary support (102) is secured on the housing for engaging against the middle frame (302) at a middle of the barrel (3).

* * * * *